US011280037B2

(12) United States Patent
Lv et al.

(10) Patent No.: US 11,280,037 B2
(45) Date of Patent: Mar. 22, 2022

(54) DRUM WASHING MACHINE AND CONTROL METHOD FOR OPENING A DOOR OF THE DRUM WASHING MACHINE DURING RUNNING

(71) Applicant: QINGDAO HAIER DRUM WASHING MACHINE CO., LTD., Shandong (CN)

(72) Inventors: Yanfen Lv, Shandong (CN); Sheng Xu, Shandong (CN); Huacheng Song, Shandong (CN)

(73) Assignee: QINGDAO HAIER DRUM WASHING MACHINE CO., LTD., Shandong (CN)

( * ) Notice: Subject to any disclaimer, the term of this patent is extended or adjusted under 35 U.S.C. 154(b) by 254 days.

(21) Appl. No.: 16/470,766

(22) PCT Filed: Dec. 19, 2017

(86) PCT No.: PCT/CN2017/117169
§ 371 (c)(1),
(2) Date: Jun. 18, 2019

(87) PCT Pub. No.: WO2018/113660
PCT Pub. Date: Jun. 28, 2018

(65) Prior Publication Data

US 2020/0087834 A1 Mar. 19, 2020

(30) Foreign Application Priority Data

Dec. 19, 2016 (CN) ..... 201611175469.4

(51) Int. Cl.
*D06F 21/04* (2006.01)
*D06F 33/00* (2020.01)
(Continued)

(52) U.S. Cl.
CPC ..... *D06F 33/32* (2020.02); *D06F 21/04* (2013.01); *D06F 33/00* (2013.01); *D06F 33/30* (2020.02);
(Continued)

(58) Field of Classification Search
None
See application file for complete search history.

(56) References Cited

U.S. PATENT DOCUMENTS

2017/0218557 A1 8/2017 Tang et al.

FOREIGN PATENT DOCUMENTS

CN 1861893 A 11/2006
CN 101397737 A 4/2009
(Continued)

OTHER PUBLICATIONS

International Search Report (PCT/ISA/210) dated Mar. 23, 2018, by the State Intellectual Property Office of the P.R. China as the International Searching Authority for International Application No. PCT/CN2017/117169.
(Continued)

*Primary Examiner* — Levon J Shahinian
(74) *Attorney, Agent, or Firm* — Buchanan Ingersoll & Rooney PC

(57) ABSTRACT

A drum washing machine and a control method for opening a door of the drum washing machine during running are provided. The control method comprises the following steps: S1, receiving a door opening instruction sent by a user; S2, judging whether a water level at a front end of a drum assembly of the drum washing machine satisfies a condition of opening the door, if yes, entering step S4, if no, entering step S3; S3, tilting the drum assembly with a tilting mechanism, and then returning to step S2; and S4, unlocking a door lock. Through a manner of lifting a front end of the
(Continued)

drum assembly, the operation of opening the door during running is realized. In this way, the original parts of the washing machine do not need to be changed.

14 Claims, 4 Drawing Sheets

(51) Int. Cl.

| | |
|---|---|
| ***D06F 33/30*** | (2020.01) |
| ***D06F 33/32*** | (2020.01) |
| ***D06F 37/18*** | (2006.01) |
| ***D06F 37/20*** | (2006.01) |
| ***D06F 37/42*** | (2006.01) |
| ***D06F 39/08*** | (2006.01) |
| ***D06F 39/14*** | (2006.01) |
| *D06F 103/16* | (2020.01) |
| *D06F 103/18* | (2020.01) |
| *D06F 105/00* | (2020.01) |
| *D06F 105/44* | (2020.01) |
| *D06F 105/46* | (2020.01) |
| *D06F 101/00* | (2020.01) |

(52) U.S. Cl.

CPC ..... *D06F 37/18* (2013.01); *D06F 37/20* (2013.01); *D06F 39/087* (2013.01); *D06F 37/42* (2013.01); *D06F 39/14* (2013.01); *D06F 2101/00* (2020.02); *D06F 2103/16* (2020.02); *D06F 2103/18* (2020.02); *D06F 2105/00* (2020.02); *D06F 2105/44* (2020.02); *D06F 2105/46* (2020.02)

(56) References Cited

FOREIGN PATENT DOCUMENTS

| | | | |
|---|---|---|---|
| CN | 102660857 | A | 9/2012 |
| CN | 103015119 | A | 4/2013 |
| CN | 104674508 | A | 6/2015 |
| CN | 104963160 | A | 10/2015 |
| CN | 104975476 | A | 10/2015 |
| CN | 105986393 | A | 10/2016 |
| CN | 205741618 | U | 11/2016 |
| CN | 205741619 | U | 11/2016 |
| KR | 20040046989 | A | 6/2004 |
| KR | 101687263 | B1 | 12/2016 |

OTHER PUBLICATIONS

Written Opinion (PCT/ISA/237) dated Mar. 23, 2018, by the State Intellectual Property Office of the P.R. China as the International Searching Authority for International Application No. PCT/CN2017/117169.

DRUM WASHING MACHINE AND CONTROL METHOD FOR OPENING A DOOR OF THE DRUM WASHING MACHINE DURING RUNNING

TECHNICAL FIELD

The present disclosure belongs to the field of home appliances, and in particular relates to a drum washing machine and a control method for opening a door of the drum washing machine during running.

BACKGROUND

As to the existing drum washing machine, in order to ensure safety in the clothes washing process, after washing procedures are started, the door lock will be locked. When finding that clothes to be washed are missed or detergent needs to be added again, a user will stop the washing machine through starting a pause button, at this time, a door opening instruction will be performed if the water level is detected to be lower than a preset water level, the temperature is below a safe temperature, and the rotating speed is lower than a preset rotating speed. Occasionally, these conditions cannot be satisfied, at this time, the user needs to discharge some of the washing water, or waits until the rotating speed and the water temperature are lower than specified values, in this way, water resource and user time are wasted, and user experience is relatively poor. To solve this problem, some manufacturer realizes the purpose of opening the door during running through setting a small door on the original door body or through discharging water during running.

In a patent with an application number of CN201510172929.7, an auxiliary door is set, and during a washing period, the auxiliary door can be freely opened and closed independent of the door.

In a patent with an application number of CN201510290335.6, a sub-door is set on a main door of a washing machine, and the sub-door realizes clothes adding during running. The main door can be pivotally connected onto the engine body through a pivot shaft so as to open or close a part of the opening, and the sub-door can be arranged on the engine body of the main door in a detachable process to open or close another part of the opening.

Through the above processes of setting auxiliary doors, the original overall appearance structure of the washing machine will be influenced, meanwhile, the problem of sealing after the setting of auxiliary doors needs to be considered. The connection between the auxiliary door and the original door body is relatively complex, the problem of connecting strength and the problem of locking of the auxiliary door body when the auxiliary door is not opened in the washing process need to be considered, therefore, the realizing process is tedious and the changes are great.

Therefore, it has become a technical problem to be urgently solved at present of how to enable the water level inside a washing machine to satisfy conditions of opening the door through tilting a drum assembly when the water level is relatively high, and further to open the door body to complete the task of opening the door during running to add clothes.

In view of this, the present disclosure is hereby proposed.

SUMMARY

The technical problem to be solved in the present disclosure is to overcome shortcomings of the prior art, and provide a drum washing machine and a control method for opening a door of the drum washing machine during running. Such that when the water level is relatively high, the water level in the washing machine can satisfy conditions of opening the door through tilting the drum assembly, and further the door body can be opened to complete the task of opening the door during running to add clothes.

In order to solve the above technical problem, basic ideas of the technical solution adopted in the present disclosure are as follows:

A first aspect of the present disclosure provides a control method for opening the door of the drum washing machine during running, including the following steps:

S1, receiving a door opening instruction sent by a user;

S2, judging whether a water level at a front end of a drum assembly of the drum washing machine satisfies a condition of opening the door, if yes, entering step S4, if no, entering step S3;

S3, tilting the drum assembly with a tilting mechanism, and then returning to step S2; and

S4, unlocking a door lock.

Preferably, step S2 specifically includes:

judging whether a probe arranged on a window mat of the drum assembly is deenergized, if yes, entering step S4, if no, entering step S3.

preferably, in step S3, the process of tilting the drum assembly with the tilting structure includes:

S3A, tilting the drum assembly by motion of a driving device arranged at a lower part of the drum assembly.

preferably, in step S3, the process of tilting the drum assembly with the tilting structure includes:

S3B, tilting the drum assembly by stretching of a hanging spring arranged at an upper part of the drum assembly.

Preferably, step S3A specifically includes:

S3A1, calculating a movement distance of the driving device according to a current water level detected by a water level sensor;

S3A2, setting number of rotating turns of a driving motor according to the movement distance of the driving device;

S3A3, tilting the drum assembly by motion of the driving device driven by the driving motor;

S3A4, judging whether the drum assembly tilts to a designated position, if yes, entering step S4, if no, returning to step S3A3.

Preferably, before step S4, the control method further includes:

S41, judging whether water temperature detected by a temperature sensor is lower than a preset temperature, if yes, entering step S4, if no, judging again whether the water temperature detected by the temperature sensor is lower than the preset temperature after waiting for a preset time.

Preferably, in step S41, after determining that the water temperature detected by a temperature sensor is greater than or equal to the preset temperature, the control method further includes:

S411, judging whether the door is allowed to be opened in an accelerated speed, if yes, then entering step S412, if no, judging again whether the water temperature detected by the temperature sensor is lower than the preset temperature after waiting for a preset time; and

S412, opening an inlet valve to supply water, then returning to step S2.

Preferably, before step S4, the control method further includes:

S42, entering step S4 after determining that a rotating speed of an inner drum is lower than a preset rotating speed.

A second aspect of the present disclosure provides a drum washing machine which uses the control method of the above first aspect. The drum washing machine includes a controller, a drum assembly, a door body and a tilting mechanism. The tilting mechanism is arranged at the drum assembly, a window mat is arranged on an opening of the drum assembly, a probe is arranged on the window mat, the probe is connected with the controller, and after the controller receives a door opening instruction, the tilting mechanism is started to tilt the drum assembly when the probe is detected to be connected in a circuit, and the door body is opened when the probe is detected to be disconnected from the circuit.

Preferably, the tilting device is selected from at least one of a group consisting of a driving device arranged on a lower part of the drum assembly, and a hanging spring arranged on an upper part of the drum assembly.

After the above technical solution is adopted, the present disclosure has the following beneficial effects compared with the prior art:

Through a process of lifting a front end of the drum assembly, the operation of opening the door during running is realized, in this way, the original parts of the drum washing machine do not need to be changed, and the drum assembly is tilted only through a driving device arranged on a lower part of the drum assembly or through a hanging spring arranged on a top part of the drum assembly, thereby not influencing appearance of the washing machine, meanwhile, the problem of sealing in the washing process does not need to be considered. In addition, while not wasting water resources, a user can open the door during running to add clothes, reduce clothes, add detergent, or perform treatment during running when finding fading of clothes.

A brief description will be further given below on specific embodiments of the present disclosure in combination with accompanying drawings.

BRIEF DESCRIPTION OF THE DRAWINGS

As a part of the present application, the drawings are used for providing further understanding of the present disclosure, and illustrative embodiments and descriptions thereof of the present disclosure are used for explaining the present disclosure, rather than constituting an improper limitation to the present disclosure. Apparently, the drawings described below are merely some embodiments, and for those skilled in the art, other drawings can be obtained according to these drawings without paying any creative effort. In the drawings.

Figure 1:
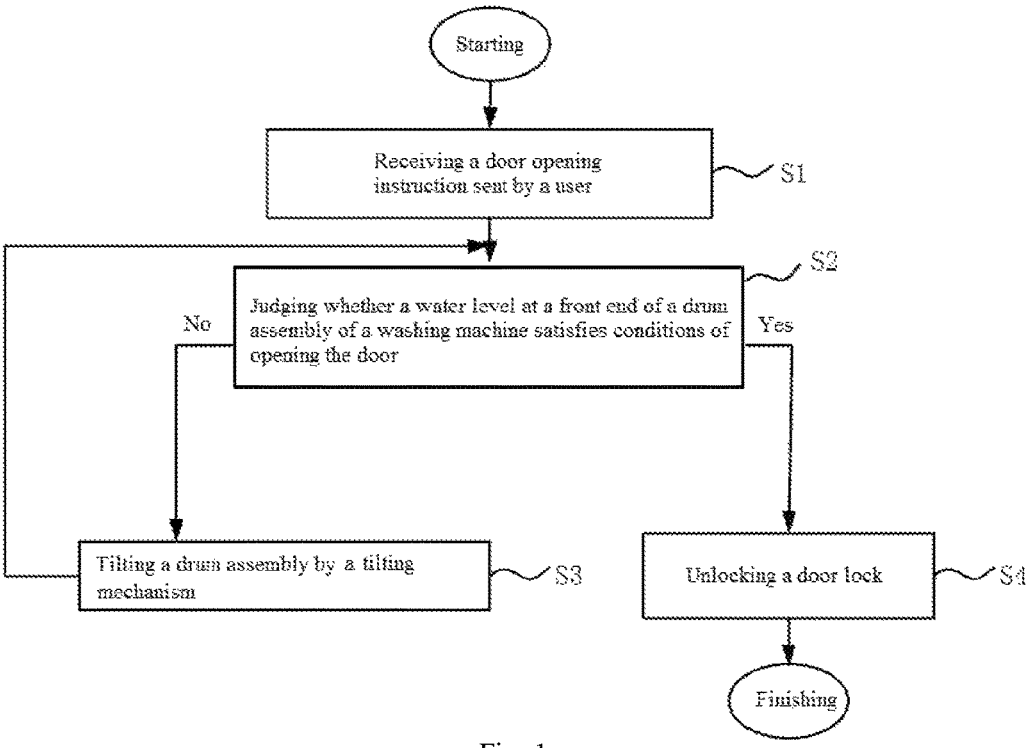
FIG. 1 is a flow chart of a control method for opening the door of a drum washing machine during running in embodiment 1 of the present disclosure.

Reference numerals in the figures: 1, drum assembly; 11, window mat; 12, probe; 2, driving device; 3, hanging spring.

It should be noted that, these drawings and text descriptions are not intended to limit in any form the conception scope of the present disclosure, but to illustrate concepts of the present disclosure for those skilled in the art with reference to specific embodiments.

DETAILED DESCRIPTION OF THE EMBODIMENTS

In order that objectives, technical solutions and advantages of the embodiments of the present disclosure are clearer, a clear and complete description will be given below on technical solutions in the embodiments in combination with drawings in embodiments of the present disclosure. The following embodiments are merely used for explaining the present disclosure, rather than for limiting the scope of the present disclosure.

In the description of the present disclosure, it should be noted that, the directional or positional relationship indicated by such terms as "upper", "lower", "front", "rear", "left", "right", "vertical", "inner" and "outer" is the directional or positional relationship shown based on the drawings, which is merely for convenient and simplified description of the present disclosure, rather than indicating or implying that the referred device or element must have the specific direction or must be constructed and operated in the specific direction, therefore, it cannot be understood as a limitation to the present disclosure.

In the description of the present disclosure, it should be noted that, unless if no definitely prescribed and defined, the terms "installation", "connected" and "connection" should be understood in its broad sense. For example, the "connection" may be a fixed connection, may also be a detachable connection or an integrated connection; may be a mechanical connection, may also be an electrical connection; and the "connected" may be directly connected and can also be indirectly connected through an intermediate medium. The specific meaning of the above-mentioned terms in the present disclosure may be understood by those of ordinary skill in the art in light of specific circumstances.

Embodiment 1

As shown in FIG. 1, an embodiment of the present disclosure provides a control method of opening the door of the drum washing machine during running, and the control method includes:

S1, receiving a door opening instruction sent by a user;

S2, judging whether a water level at a front end of a drum assembly of the drum washing machine satisfies a condition of opening the door, if yes, entering step S4, if no, entering step S3;

S3, tilting the drum assembly by a tilting mechanism, and then returning to step S2; and S4, unlocking a door lock.

In the above technical solution, when clothes are washed in the drum washing machine, and when a user wants to add clothes to the washing machine, the user can trigger a door opening button on a control panel of the drum washing machine, then a controller will receive a door opening instruction. Before the door opening is allowed, the controller firstly judges whether a water level of the washing machine satisfies conditions of opening the door, that is, whether the water level in the drum assembly of the washing machine is overhigh, if the water level is overhigh, the door lock cannot be unlocked by the washing machine, a front end of a drum assembly needs to be jacked up by a tilting mechanism. Such that a rear end is sunk, and further the water level at the front end of the drum assembly of the washing machine is lowered, until the conditions of opening the door are satisfied and the door lock is unlocked, and then the user can open the door body. After receiving a door opening instruction, if the controller detects that the water level at a front end of the drum assembly of the washing machine satisfies conditions of opening the door (namely, the water level is relatively low), then the drum assembly does not need to be tilted, and then the door lock on the door body will be unlocked, such that the user can directly open the door body.

Wherein, the drum assembly includes an inner drum and an outer drum. Therefore, when whether the water level at a front end of the drum assembly of a washing machine satisfies conditions of opening the door is judged, if the inner drum is a holeless inner drum, whether the water level at the front end of the inner drum satisfies conditions of opening the door is judged; if the inner drum is a perforated inner drum, since water will enter the outer drum via the hole, at this time, whether the water level at a front end of the outer drum satisfies conditions of opening the door needs to be judged.

Through the above technical solution, and through a process of lifting the front end of the drum assembly, the operation of opening the door during running is realized. In this way, the original parts of a washing machine do not need to be changed, and the drum assembly is tilted only through a driving device arranged on a lower part of the drum assembly or through a hanging spring arranged on a top part of the drum assembly, thereby not influencing appearance of the washing machine, meanwhile, the problem of sealing in the washing process does not need to be considered. In addition, while not wasting water resources, a user can open the door during running to add clothes, reduce clothes, add detergent, or perform treatment during running when finding fading of clothes.

Preferably, step S2 specifically includes:

judging whether a probe arranged on a window mat of the drum assembly is deenergized, if yes, then entering step S4, if no, entering step S3.

Since water may be accumulated in the window mat, a probe needs to be arranged on a side face of the window mat, then the probe will not be influenced by accumulated water of the window mat, and the water level of the drum assembly can be detected in real time.

In the above technical solution, a probe is arranged on the window mat. When the water level is overhigh, water will be in contact with the probe, in this way, since water is also conductive, the probe will be connected in a circuit, then it is judged whether the water level at the front end of the drum assembly satisfies conditions of opening the door according to whether the probe is at a deenergized state. When the probe is deenergized, it proves that the water level is low and the door body can be opened. When the probe is energized, it proves that the water level is relatively high, the drum assembly needs to be tilted, the front end of the drum assembly is jacked up, and further the water level at a front end is lowered, and the drum assembly is tilted until the probe is deenergized, at this time, a user can open the door body to add clothes during running.

Through the above technical solution, whether the water level at the front end of the drum assembly satisfies conditions of opening the door is detected according to energization or deenergization of the probe, and further tilting degree of the drum assembly is automatically adjusted, thereby satisfying the operating process of opening the door during running to add clothes, and bringing convenience to users.

Preferably, in step S3, the process of tilting a drum assembly by a tilting structure includes:

S3A, tilting the drum assembly by motions of a driving device arranged at a lower part of the drum assembly, and/or S3B, tilting the drum assembly by stretching of a hanging spring which is arranged on an upper part of the drum assembly.

In the above technical solution, the front end of the drum assembly can be lifted through the driving device, and the front end of the drum assembly can be lifted through a hanging spring, and the effect of tilting the drum assembly can be achieved by simultaneously a driving device and a hanging spring. In this way, on the basis of not changing the original internal structure of the washing machine, the water level at the front end of the drum assembly satisfies the conditions of opening the door during running, thereby not only saving cost of the washing machine, but also facilitating updating operation of a system of the washing machine.

Figure 2:
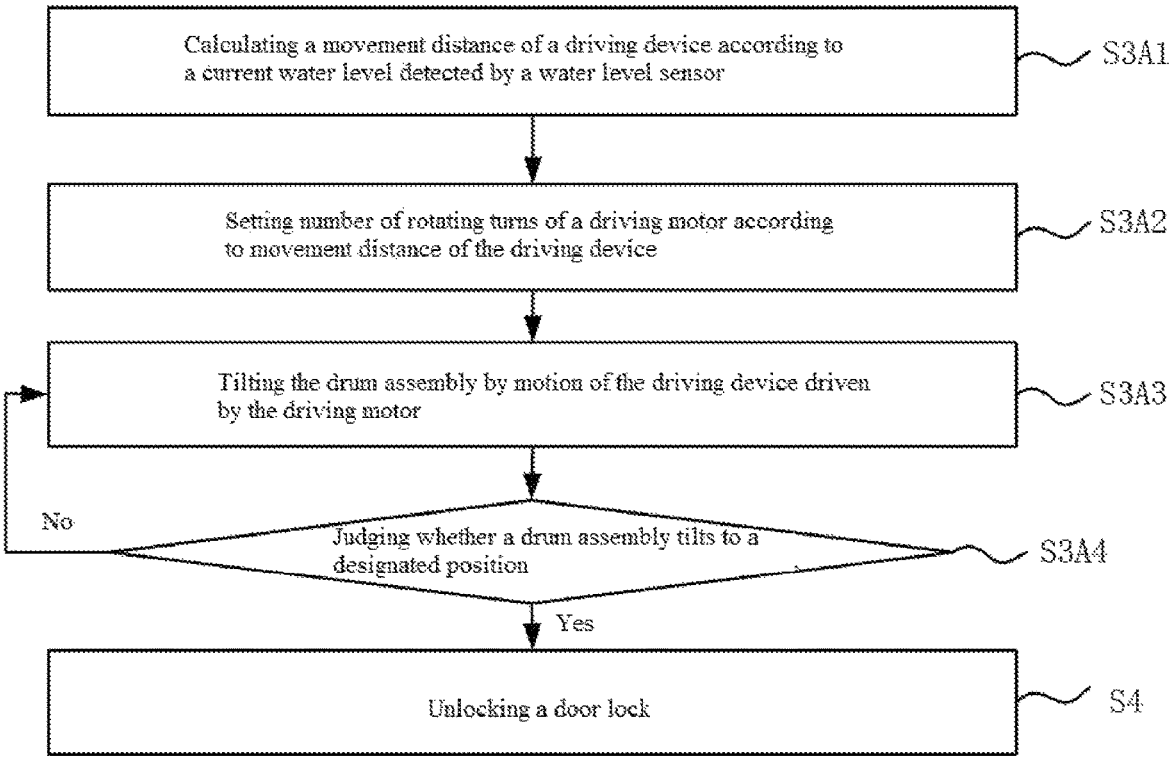
FIG. 2 is an expanded schematic diagram of step S3A of the present disclosure.

As shown in FIG. 2, step S3A specifically includes:

S3A1, calculating a movement distance of the driving device according to a current water level detected by a water level sensor;

S3A2, setting number of rotating turns of a driving motor according to the movement distance of the driving device;

S3A3, driving the driving device to move by the driving motor, and tilting the drum assembly; and S3A4, judging whether the drum assembly tilts to a designated position, if yes, entering step S4, if no, returning to step S3A3.

In the above technical solution, in the process of tilting the drum assembly by the driving device, the movement distance of the driving device (namely, the degree to which the drum assembly should be tilted) is calculated according to current water level of a water level sensor, and the movement distance is converted to a number of rotating turns of a driving motor, and further the driving device is driven to move to a corresponding position under the rotation of the driving motor, thereby achieving the purpose of tilting the drum assembly, and enabling the water level at the front end of the drum assembly to satisfy conditions of opening the door. If the conditions of opening the door are not satisfied (namely, the drum assembly is not tilted to a designated position), the drum assembly will be tilted continuously by a driving device, until the drum assembly is tilted to a degree at which the conditions of opening the door are satisfied.

Figure 3:
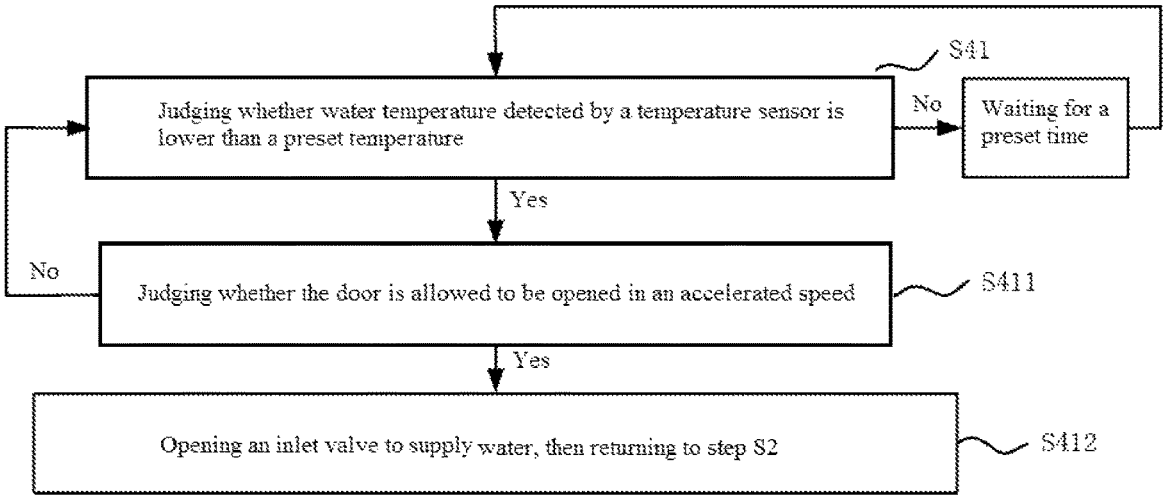
FIG. 3 is an expanded schematic diagram before step S4 of the present disclosure.

As shown in FIG. 3, before step S4, the control method further includes:

S41, judging whether water temperature detected by a temperature sensor is lower than a preset temperature, if yes, entering step S4, if no, judging again whether the water temperature detected by a temperature sensor is lower than a preset temperature after waiting for a preset time.

In the above technical solution, when the water level satisfies conditions of opening the door and before the door body is opened, it should be detected whether the water temperature within the drum is lower than a preset temperature. If the water temperature at this time is lower than the preset temperature, it proves that the water temperature can satisfy conditions of opening the door. If the water temperature at this time is higher than the preset temperature, it proves that the water temperature at this time is too high to open the door, after waiting for a preset time (for example, 2 minutes), it should be detected again whether the water temperature is lower than the preset temperature. If conditions are not satisfied, then wait continuously, until the water temperature is lower than a preset temperature, and conditions of opening the door are satisfied.

Preferably, in step S41, after determining that the water temperature detected by a temperature sensor is greater than or equal to a preset temperature, the control method further includes:

S411, judging whether door opening in an accelerated speed is allowed, if yes, then entering step S412, if no, judging again whether the water temperature detected by the temperature sensor is lower than a preset temperature after waiting for a preset time; and S412, opening an inlet valve to supply water, then returning to step S2.

In the above technical solution, when the water temperature is judged to be high (namely, greater than or equal to a preset temperature), a user can select whether to accelerate to open the door according to actual requirements. If a user selects to accelerate to open the door, then an inlet valve is opened to supply water. Since the water level will be changed after water is supplied, therefore, after water is supplied, it should be determined again whether the water level at this time satisfies the conditions of opening the door (that is, returning to step S2 again); if a user does not accelerate to open the door, in order to ensure that the water temperature during door opening can be lower than the preset temperature, the user needs to wait for a preset time, until the water temperature is lowered to a preset temperature. The preset time is calculated according to a water temperature detected by a temperature sensor, that is, the larger the water temperature is higher than a preset temperature value, the longer the required preset time is.

Preferably, before step S4, the control method further includes:

S42, entering step S4 after determining that a rotating speed of an inner drum is lower than a preset rotating speed.

In the above technical solution, since when a user opens the door during running to add clothes, the washing machine may be in a process of high-speed rotation, at this time, if the door is opened in a forced process, the user may be damaged, and the washing machine will be damaged simultaneously. In order to avoid such a condition, the door body is allowed to be opened after determining that the rotating speed of an inner drum is smaller than a preset rotating speed. If the rotating speed of the inner drum is high and is larger than or equal to the preset rotating speed, then the door can be chosen to open after the rotating speed of the inner drum is reduced to be smaller than the preset rotating speed, or braking can be started to reduce the rotating speed of the inner drum to be smaller than a preset rotating speed.

Further, through the above technical solution, when the water level satisfies the conditions of opening the door, the door body can be opened after both the temperature and the rotating speed of a washing machine are ensured to satisfy conditions of opening the door.

Embodiment 2

Figure 4:
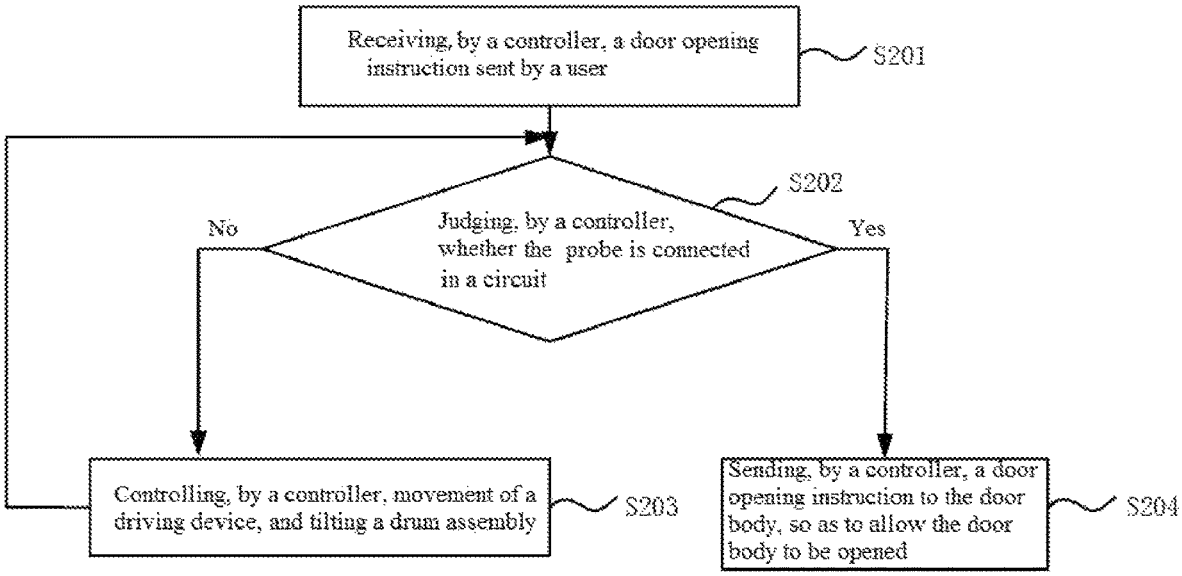
FIG. 4 is a flow chart of a control method for opening the door of a drum washing machine during running of embodiment 2 of the present disclosure.

As shown in FIG. 4, the control method for opening the door of a drum washing machine during running of the present embodiment includes the following steps:

S201, receiving, by a controller, a door opening instruction sent by a user;

S202, judging, by a controller, whether the probe is connected in a circuit, if yes, entering step S203, if no, entering step S204;

S203, controlling, by a controller, movement of a driving device, and returning to step S202 after tilting a drum assembly;

S204, sending, by a controller, a door opening instruction to the door body, so as to allow the door body to be opened.

Embodiment 3

Figure 5:
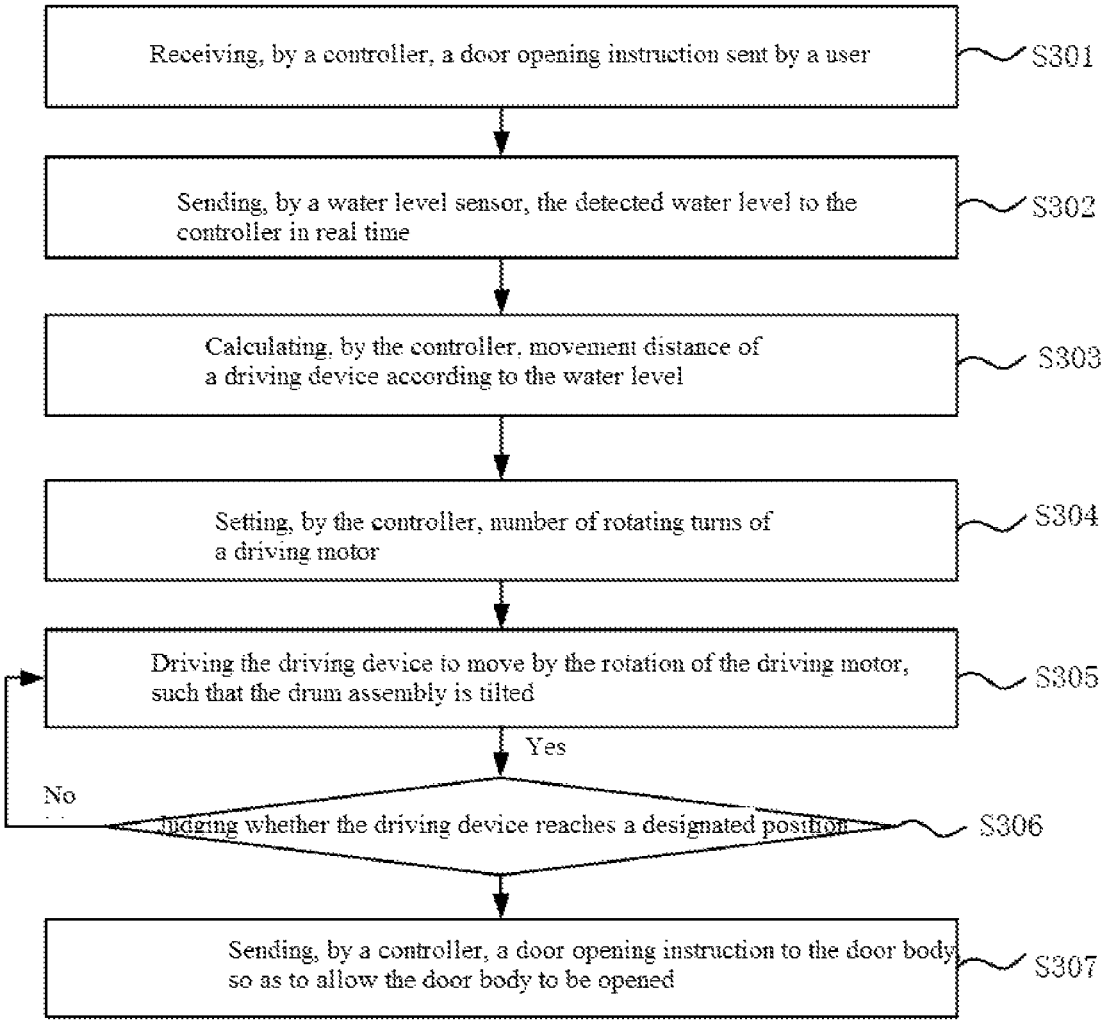
FIG. 5 is a flow chart of a control method for opening the door of a drum washing machine during running of embodiment 3 of the present disclosure.

As shown in FIG. 5, the control method of opening the door of a drum washing machine during running of the present embodiment includes the following steps:

S301, receiving, by a controller, a door opening instruction sent by a user;

S302, sending, by a water level sensor, the detected water level to the controller in real time;

S303, calculating, by the controller, movement distance of a driving device according to the water level;

S304, setting, by the controller, number of rotating turns of a driving motor;

S305, driving the driving device to move by the rotation of the driving motor, such that the drum assembly is tilted;

S306, judging whether the driving device reaches a designated position, if yes, entering step S307, if no, returning to S305; and S307, sending, by a controller, a door opening instruction to the door body, so as to allow the door body to be opened.

Through the above technical solution, motion of the driving device can be more accurately controlled by a driving motor.

Embodiment 4

Figure 6:
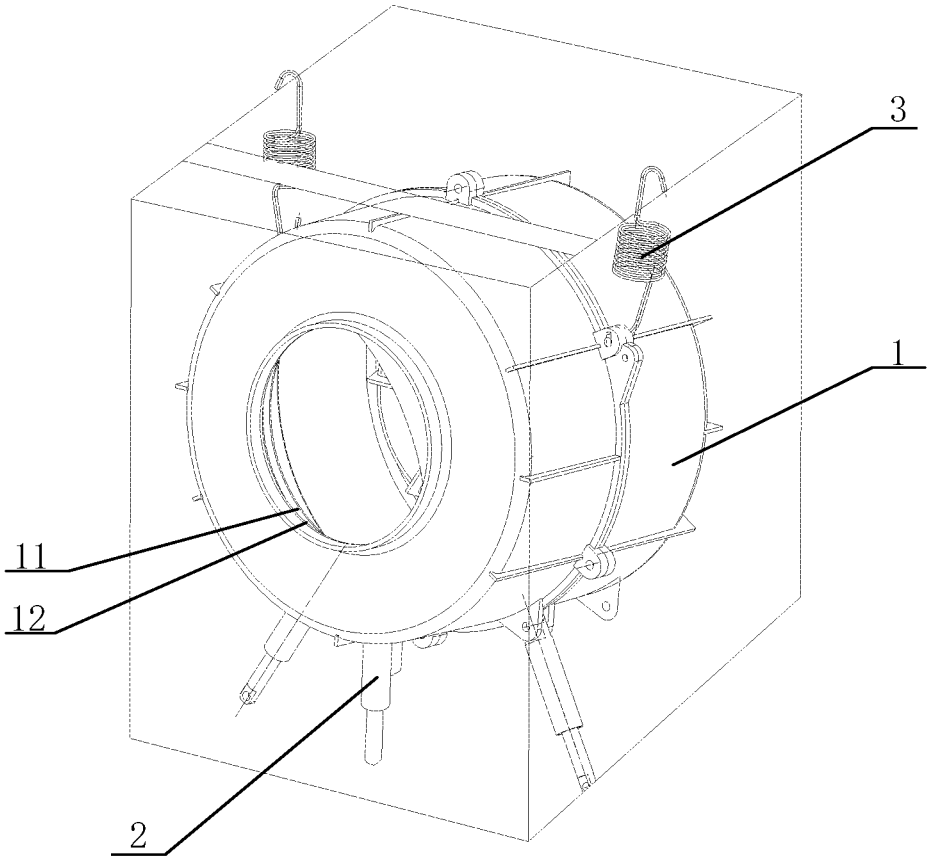
FIG. 6 is a structure chart of a drum washing machine of the present disclosure.

As shown in FIG. 6, an embodiment of the present disclosure provides a drum washing machine which uses the control method of the above embodiments. The drum washing machine includes a controller, a drum assembly 1, a door body and a tilting mechanism. The tilting mechanism is arranged on a drum assembly 1, a window mat 11 is arranged on an opening of the drum assembly 1, a probe 12 is arranged on the window mat 11. The probe 12 is connected with the controller, and after the controller receives a door opening instruction, the tilting mechanism is started to tilt the drum assembly 1 when the probe is detected to be connected in a circuit, and the door body is opened when the probe is detected to be disconnected from the circuit.

In the above technical solution, the probe 12 is arranged on the window mat 11. In this way, once the water level is too high, water will be in contact with the probe 12, such that the probe 12 is connected in a circuit, then a controller will start to tilt the drum assembly 1. If the water level is relatively low, water will not be in contact with the probe 12, then the probe will be disconnected from the circuit, and when the controller does not receive signals showing that the probe is connected in a circuit, then the door body will be opened.

Preferably, the tilting device is selected from at least one of a group consisting of a driving device 2 arranged on a lower part of the drum assembly 1, and a hanging spring 3 arranged on an upper part of the drum assembly 1.

In the above technical solution, a front end of the drum assembly 1 can be lifted through a driving device 2, and the front end of the drum assembly 1 can be also lifted through a hanging spring 3, and the effect of tilting the drum assembly 1 can be achieved by simultaneously a driving device 2 and a hanging spring 3. In this way, on the basis of not changing the original internal structure of the washing machine, the water level at a front end of the drum assembly 1 satisfies the conditions of opening the door during running.

The above descriptions are merely preferred embodiments of the present disclosure, rather than a limitation to the present disclosure in any form. Although the present disclosure is disclosed above through the preferred embodiments, however, the present disclosure is not limited hereto. Those skilled in the art can make some changes or modify to equivalent embodiments with equivalent changes by the technical contents enlightened above under the premise of not departing from the scope of the technical solution of the present disclosure. As long as the contents do not depart from the technical solution of the present disclosure, any simple alterations, equivalent changes and modifications made to the above embodiments according to the technical essence of the present disclosure shall still fall within the scope of the solution of the present disclosure.

The invention claimed is:

1. A control method for opening a door of a drum washing machine during running, comprising the following steps:

S1, receiving a door opening instruction sent by a user;

S2, judging whether a water level at a front end of a drum assembly of the drum washing machine satisfies a condition of opening the door, if yes, entering step S4, if no, entering step S3;

step S3 comprises:

S3A1, calculating a movement distance of a driving device arranged at a lower part of the drum assembly according to a current water level detected by a water level sensor;

S3A2, setting a number of rotating turns of a driving motor according to the movement distance of the driving device;

S3A3, tilting the drum assembly by motion of the driving device driven by the driving motor;

S3A4, judging whether the drum assembly tilts to a designated position, if yes, entering step S2, if no, returning to step S3A3; and S4, unlocking a door lock.

2. The control method according to claim 1, wherein step S2 comprises:

judging whether a probe arranged on a window mat of the drum assembly is deenergized, if yes, entering step S4, otherwise, entering step S3.

3. The control method according to claim 2, wherein in step S3, a process of tilting the drum assembly with the tilting mechanism comprises:

S3B, tilting the drum assembly by stretching of a hanging spring arranged at an upper part of the drum assembly.

4. The control method according to claim 2, wherein before step S4, the control method further comprises:

S42, entering step S4 after determining that a rotating speed of an inner drum is lower than a preset rotating speed.

5. The control method according to claim 1, wherein in step S3, a process of tilting the drum assembly with the tilting mechanism comprises:

S3B, tilting the drum assembly by stretching of a hanging spring arranged at an upper part of the drum assembly.

6. The control method according to claim 5, wherein before step S4, the control method further comprises:

S42, entering step S4 after determining that a rotating speed of an inner drum is lower than a preset rotating speed.

7. The control method according to claim 1, wherein before step S4, the control method further comprises:

S41, judging whether water temperature detected by a temperature sensor is lower than a preset temperature, if yes, entering step S4, if no, judging again whether the water temperature detected by the temperature sensor is lower than the preset temperature after waiting for a preset time.

8. The control method according to claim 7, wherein in step S41, after determining that the water temperature detected by the temperature sensor is greater than or equal to the preset temperature, the control method further comprises:

S411, judging whether the door is allowed to be opened in an accelerated speed, if yes, then entering step S412, if no, judging again whether the water temperature detected by the temperature sensor is lower than the preset temperature after waiting for a preset time; and S412, opening an inlet valve to supply water, then returning to step S2.

9. The control method according to claim 8, wherein before step S4, the control method further comprises:

S42, entering step S4 after determining that a rotating speed of an inner drum is lower than a preset rotating speed.

10. The control method according to claim 7, wherein before step S4, the control method further comprises:

S42, entering step S4 after determining that a rotating speed of an inner drum is lower than a preset rotating speed.

11. The control method according to claim 1, wherein before step S4, the control method further comprises:

S42, entering step S4 after determining that a rotating speed of an inner drum is lower than a preset rotating speed.

12. A drum washing machine comprising:

a controller;

a drum assembly;

a door body; and a tilting mechanism, wherein, the tilting mechanism is arranged at the drum assembly, a window mat is arranged on an opening of the drum assembly, and a probe is arranged on the window mat, the probe is connected with the controller, wherein the controller is configured to perform the following steps:

S1, receiving a door opening instruction sent by a user;

S2, judging whether a water level at a front end of a drum assembly of the drum washing machine satisfies a condition of opening the door when the probe is detected to be disconnected from a circuit, if yes, entering step S4, if no, entering step S3;

step S3 comprises:

S3A1, calculating a movement distance of a driving device arranged at a lower part of the drum assembly according to a current water level detected by a water level sensor;

S3A2, setting number of rotating turns of a driving motor according to the movement distance of the driving device;

S3A3, tilting the drum assembly by motion of the driving device driven by the driving motor;

S3A4, judging whether the drum assembly tilts to a designated position when the probe is connected to the circuit, if yes, entering step S2, if no, returning to step S3A3; and S4, unlocking a door lock.

13. The drum washing machine according to claim 12, wherein the tilting mechanism includes the driving device arranged on a lower part of the drum assembly, and a hanging spring arranged on an upper part of the drum assembly.

14. A control method for opening a door of a drum washing machine during running, comprising the following steps:

S1, receiving a door opening instruction sent by a user;

S2, judging whether a water level at a front end of a drum assembly of the drum washing machine satisfies a condition of opening the door, if yes, entering step S4, if no, entering step S3;

S3, tilting the drum assembly with a tilting mechanism including a hanging spring wherein the drum assembly is tilted by stretching the hanging spring arranged at an upper part of the drum assembly returning to step S2; and S4, unlocking a door lock.

* * * * *